US005722266A

United States Patent [19]

Yeager et al.

[11] Patent Number: 5,722,266

[45] Date of Patent: Mar. 3, 1998

[54] UNIVERSAL WRAP SECURITY DEVICE

[75] Inventors: Lawrence R. Yeager, Uniontown; James T. Weisburn, Massillon; Christopher G. Gallagher, Akron; Ronald M. Marsilio, Mogadore; William G. Alford, Akron, all of Ohio

[73] Assignee: Alpha Enterprises, Inc., North Canton, Ohio

[21] Appl. No.: 561,370

[22] Filed: Nov. 21, 1995

[51] Int. Cl.[6] ..... E05B 65/00

[52] U.S. Cl. ..... 70/57; 70/49; 242/596; 242/421; 24/18

[58] Field of Search ..... 70/57.1, 49, 67, 70/69, 76, 413, 18, 16; 242/421, 421.8, 596; 24/16 R, 115 F, 115 G, 115 N, 127, 19; 206/807; 2/321, 322

[56] References Cited

U.S. PATENT DOCUMENTS

| | | | |
|---|---|---|---|
| 199,468 | 1/1878 | Rheubottom | 70/49 |
| 394,739 | 12/1888 | Toulmin | 24/127 |
| 437,548 | 9/1890 | Anderson | 24/127 |
| 596,237 | 12/1897 | Damon | 70/18 |
| 639,196 | 12/1899 | Fehling | 70/49 |
| 673,612 | 5/1901 | Appleby | 70/49 |
| 886,905 | 5/1908 | Ward | 24/18 |
| 895,403 | 8/1908 | Jackson | 24/127 |
| 1,083,612 | 1/1914 | Hooker | 70/18 |
| 1,124,130 | 1/1915 | Grant | 24/18 |
| 1,141,245 | 6/1915 | Gillespie | 24/18 |
| 1,165,320 | 12/1915 | Clary | 24/18 |
| 1,165,816 | 12/1915 | Tichenor | 24/18 |
| 1,657,190 | 1/1928 | Ballou | 24/19 |
| 2,002,946 | 5/1935 | Jacobs | 2/321 |
| 3,395,555 | 8/1968 | Hickman | 70/276 |
| 3,466,668 | 9/1969 | Ochiai | 2/322 |
| 3,611,760 | 10/1971 | Muther | 70/58 |
| 3,831,407 | 8/1974 | Coleman | 70/18 |
| 3,906,758 | 9/1975 | Hurwitt | 70/30 |
| 4,071,023 | 1/1978 | Gregory | 128/133 |
| 4,086,795 | 5/1978 | Foster et al. | 70/233 |
| 4,418,551 | 12/1983 | Kochackis | 70/18 |
| 4,756,171 | 7/1988 | Homar | 70/18 |
| 4,896,517 | 1/1990 | Ling | 70/18 |
| 4,930,324 | 6/1990 | Meier | 70/18 |
| 4,949,679 | 8/1990 | Wolfer | 119/96 |
| 5,144,821 | 9/1992 | Ernesti et al. | 70/159 |
| 5,156,028 | 10/1992 | Jiang | 70/30 |
| 5,193,368 | 3/1993 | Ling | 70/30 |
| 5,345,947 | 9/1994 | Fischer | 128/878 |
| 5,379,496 | 1/1995 | Krauss | 24/625 |
| 5,517,836 | 5/1996 | Hong | 70/30 |
| 5,551,447 | 9/1996 | Hoffman et al. | 128/869 |
| 5,581,853 | 12/1996 | Miller et al. | 24/302 |

FOREIGN PATENT DOCUMENTS

| | | | |
|---|---|---|---|
| 2725580 | 7/1977 | Germany | 70/58 |
| 123470 | 11/1948 | Sweden | 70/18 |

*Primary Examiner*—Steven N. Myers
*Assistant Examiner*—Tuyet-Phuong Pham
*Attorney, Agent, or Firm*—Sand & Sebolt

[57] ABSTRACT

A security device which includes a locking member, a ratchet member, and a plurality of cables. The cables extend through both a fastener and a base of the locking member and are wrapped around all six sides of a book or box-like structure. The fastener is releasably snap-fitted into the base and secured therein by a pair of metal tines. The ratchet member includes a housing containing a gear and bearing member which are latched together in a spaced relationship to form a reel and a pawl. A bottom plate encloses the contents of the housing. The gear includes a multi-sided key hole, a plurality of openings to secure enlarged ends of the cables therein, and a plurality of teeth. The gear and bearing member each include an annular nub which sits in and rotates around a corresponding bearing surface of the bottom plate and housing, respectively. The pawl has a catch and a resilient spring and communicates with the gear to allow the ratchet member to be turned only in one direction. Two specialized tools are required to tighten the device around the box-like structure and to remove the security device from the same.

21 Claims, 6 Drawing Sheets

UNIVERSAL WRAP SECURITY DEVICE

BACKGROUND OF THE INVENTION

1. Technical Field

The invention relates to a security device. More particularly the invention relates to an adjustable security device which wraps around and secures a box, book, or other similarly structured articles of various sizes in a closed position. Even more particularly the invention relates to a universal wrap security device which includes a plurality of wires or cables that wrap around the article and extend between a ratchet member and a locking member, both of which require a special tool to operate.

2. Background Information

Retail stores have a difficult time protecting boxes containing various expensive merchandise, books and other similarly structured packages or objects from being opened and the contents thereof being removed without authorization from store personnel or damaged while on display. Consumers often want to visually inspect the packaged expensive articles before deciding to purchase them. The store is faced with the problem of how to protect these expensive articles from theft while displaying them for sale.

One method used to protect these packages and the articles contained therein is to enclose the article within a transparent glass display case which can only be accessed from behind a counter of the retail store. The consumer can view the article through the glass but is not able to handle the article or read any of the information about the article that may be printed on the box unless a store clerk removes the article from the case. However, in large retail stores, the problem then arises of getting the selected merchandise to the customer after the customer wishes to purchase the same without subjecting the merchandise to theft. One manner is to maintain a supply of the boxes containing the expensive articles or merchandise close at hand for delivery to or pick-up by the customer for subsequent taking to a check-out clerk. However this makes the boxes susceptible to theft.

Another method used by retail stores is to list the article in a catalog and require consumers to place an order from the catalog. The article is delivered from a back storage area and the consumer must simultaneously pick up and pay for the merchandise at the same location to prevent unauthorized removal from the store. The consumer does not get to inspect the article before purchasing and if they are not satisfied they must undergo the hassle of returning the article for a refund.

Boxes and box-like structures are also subjected to unauthorized openings while being shipped via a courier. These articles can be easily opened and resealed when packaged and taped-shut in the conventional manner without the recipient or the sender knowing of such actions. Shipped packages can be secured within a security container with a locking mechanism but these containers are expensive to purchase and add size and weight to the package making it more expensive to ship. Also, would-be thieves can gain unauthorized access to the contents of these containers by "picking" the locking mechanisms or possibly guessing the combination to a combination lock.

Few prior art locking devices have adequately solved this problem of securing packages or objects in a closed condition while being displayed in retail stores or shipped from one location to another. Some prior art security devices include a wire which wraps around an article and is secured by some type of locking mechanism. For example, U.S. Pat. No. 3,611,760 discloses a locking device which utilizes a retractable cable mounted in a housing, wherein the cable loops around an object to be secured, and is then locked in the housing by a combination lock.

U.S. Pat. No. 4,756,171 discloses a locking device having a cable which extends about the object to be secured, together with a take-up reel mounted in the lock member for tightening the cable by a crank handle in the lock member.

U.S. Pat. No. 4,896,517 discloses a locking device which has a cable with a locking head wound about a reel having a ratchet and pawl locking mechanism. The locking head engages the locking mechanism to secure the cable in a locked position.

U.S. Pat. No. 5,156,028 discloses a portable locking device using a ratchet-like retrieving reel, to which is connected a locking cable.

Other prior art security devices have offered different methods to secure various articles. U.S. Pat. No. 3,831,407 discloses a locking device consisting of a plurality of flexible wire-like members which extend about an object to be secured, with open ends of the chains being secured by a lock.

U.S. Pat. No. 4,418,551 discloses a security device which is mounted about a rectangular object, such as a vending machine. The device includes a strap structure extending around portions of the rectangular object, a door moveable between open and closed positions, and a locking mechanism to lock the door in the closed position.

U.S. Pat. No. 4,930,324 discloses a lockable buckle which has a rotatably mounted tumbler in a lock housing which locks a clasp member to the housing.

Although these prior art devices are adequate for the purpose for which they were intended, none of these prior art devices include a portable lightweight device which has a ratchet member which uses a tool to tighten a plurality of cable or cable sections around box-like structures of various sizes, and which has a two-piece locking member which snap-fits together and uses an unlocking tool or key with magnetic arms to dismantle the two-piece locking member before the article contained within the box can be removed therefrom.

Therefore, the need exists for a universal security device which includes a ratchet member and a locking member, which uses two separate tools to operate the device, which encloses the package on all six sides, which includes a one-way ratchet which can be released only after the device is removed from the package, which can be reused indefinitely, which does not add significant size or weight to the package, and which is readily adjustable for a variety of sized boxes. There is no such security device of which we are aware which accomplishes these results.

SUMMARY OF THE INVENTION

The security device of the present invention includes a plurality of wires or cables which encircle and lock all six sides of a box, package, book or other similar structure. The cable extends between a ratchet member which includes a gear with a plurality of teeth, a one-way pawl which engages the teeth, and a locking member which includes a fastener which snap-fits to a base and requires an unlocking tool to unlock. The one-way ratchet also requires a tool to tighten the cables around the package being protected, and the pawl which can be disengaged from the ratchet teeth only from a rear side of the ratchet member after the device has been removed from the package.

Therefore, in accordance with the above, objectives of the present invention include providing a security device which includes a ratchet member and a locking member and a plurality of cables extending between said members and around an object to be secured in a closed position.

Another objective of the present invention is to provide such a security device which requires two separate tools to lock and unlock the device and tighten the cables around the article being protected by the device.

A further objective of the present invention is to provide such a security device which encloses the object or package on all six sides.

A still further objective of the present invention is to provide such a security device which includes a one-way ratchet which can be released only after the device has been removed from the package.

Another objective of the present invention is to provide such a security device which can be reused indefinitely, and which does not add significant size or weight to the package, and which can be formed of a high-strength plastic material not readily affected by chemicals and moisture.

These objectives and advantages are obtained by the security device of the present invention the general nature of which may be stated as including cable means for placement about an object to be secured; ratchet means connected to the cable means for tightening the cable means around the object; and a two-piece locking member, each piece being connected to the cable means, said pieces being releasably engaged with each other for releasably locking said cable means about the object.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

Similar numbers refer to similar parts throughout the drawings.

DESCRIPTION OF THE PREFERRED EMBODIMENT

Figure 1:
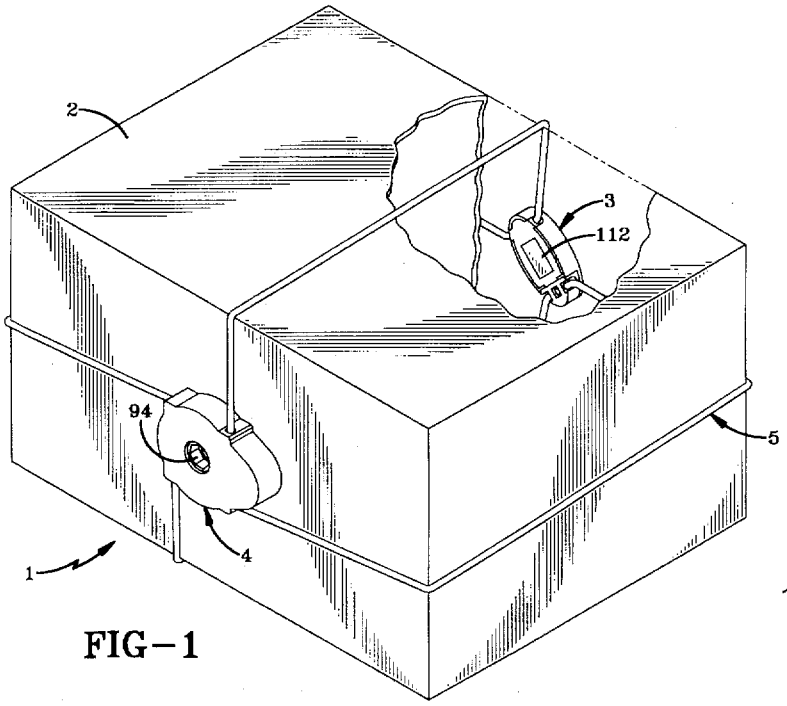
FIG. 1 is a perspective view showing the universal security wrap of the present invention mounted and secured on a package, portions of which are broken away.
Figure 2:
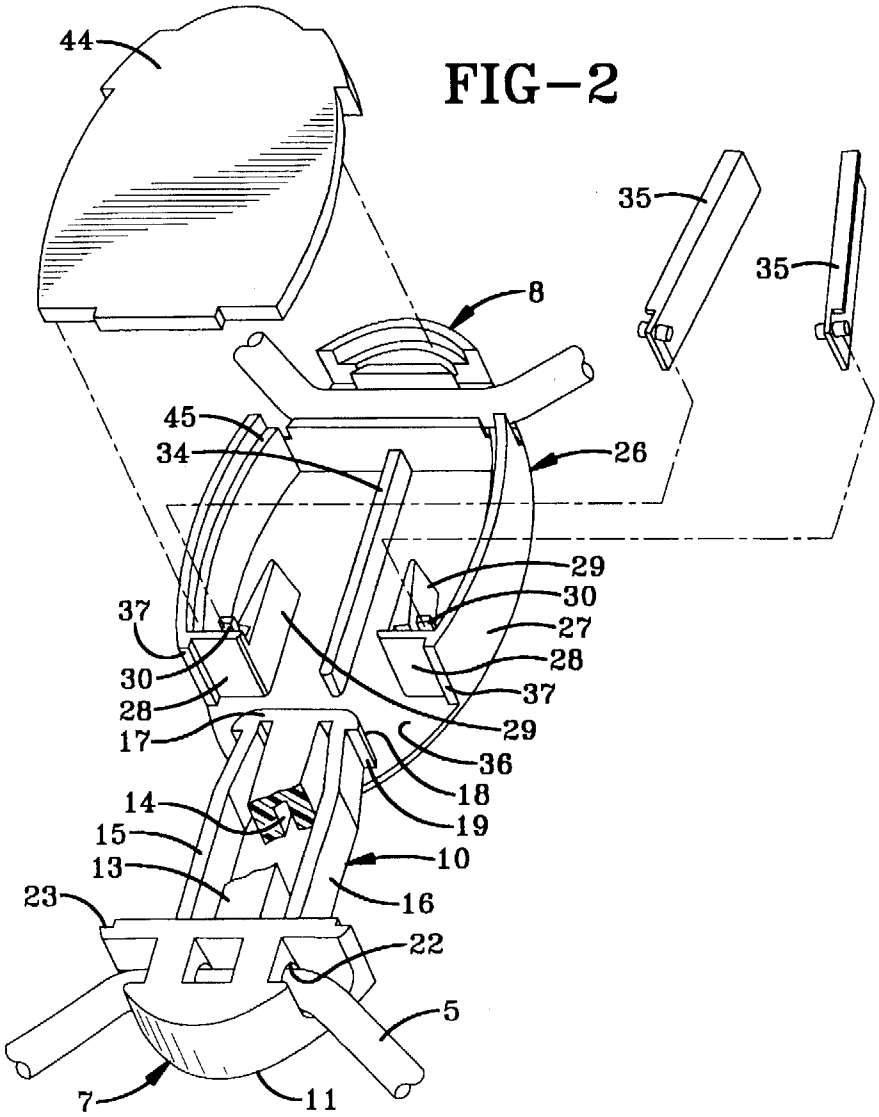
FIG. 2 is an exploded perspective view of the locking member of the security device in an unlocked position.

The universal wrap security device of the present invention is indicated generally at 1, and shown locked to a package 2 in FIG. 1. Security device 1 includes a locking member 3, a ratchet member 4 and a plurality of connecting cables 5. Locking member 3 includes two main components, a fastener 7 (FIGS. 2–5) which is inserted and locks into an oval-shaped base 8. Fastener 7 has a leg 10 (FIGS. 2 and 3) integrally formed with and extending from an ear shaped lug 11. Leg 10 includes a rectangular-shaped center post 13 intermediate two spaced generally parallel tangs 15 and 16. A U-shaped groove 14 is formed in a back side of post 13. An end of each tang 15 and 16 is angled inwardly toward post 13, and post 13 and tangs 15 and 16 are connected integrally at a free end 17. End 17 has rounded edges 18 which extend beyond the inwardly angled portions of tangs 15 and 16 and form flat locking tabs 19.

A circular opening 22 is formed in lug 11 and allows cable 5 to extend therethrough. A pair of notches 23 are formed in each side of lug 11 on a flat side thereof, and assist in guiding fastener 7 into base 8 and centrally stabilizes fastener 7 therein, as described below in further detail.

Figure 3:
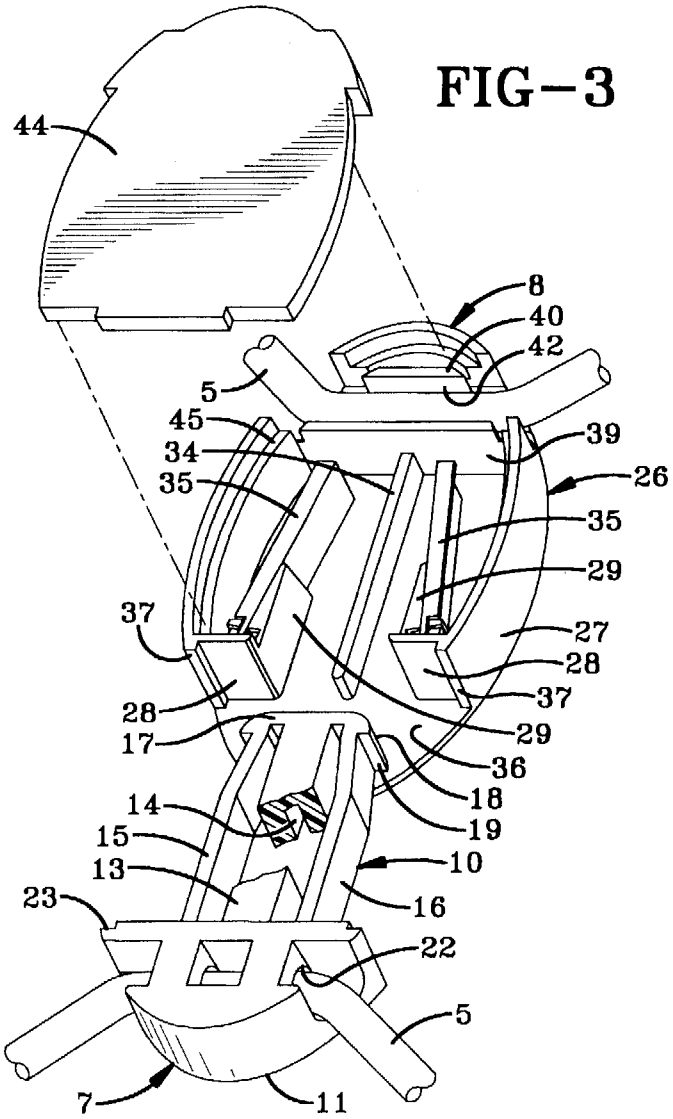
FIG. 3 is a perspective view similar to FIG. 2 with the metal locking tines mounted within the base.
Figure 4:
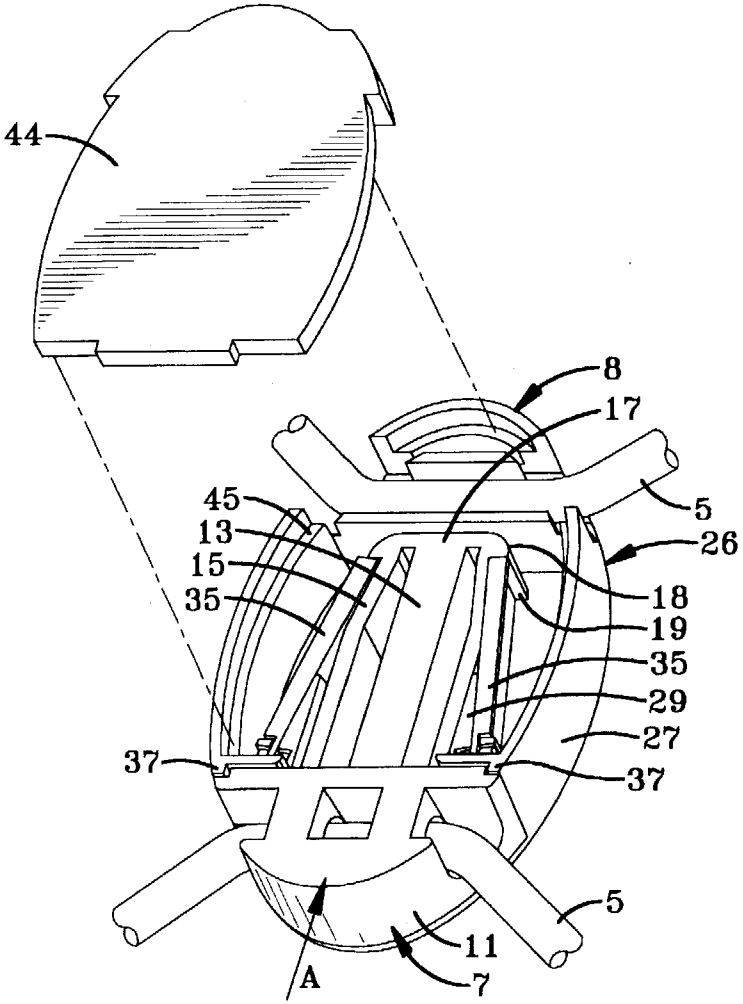
FIG. 4 is a perspective view of the locking member of FIGS. 2 and 3 showing the fastener snap-fit to the base in a locked position with the cover removed.

Base 8 includes an oval-shaped bottom member 26 which has an upstanding curved side wall 27 extending partially around the perimeter of bottom member 26, and a pair of end walls 28 extending inwardly from opposite ends of wall 27. A pair of tapered prongs 29 extend inwardly perpendicularly from an end of each end wall 28. A pair of tabs 30 extend inwardly parallel to a tapered edge of prongs 29 and further extend from end walls 28 between outer wall 27 and prongs 29. A pair of substantially L-shaped metal tines 35 are inserted and secured between prongs 29 and tabs 30, and extend angularly inwardly and terminate adjacent a second end wall 39 (FIGS. 3 and 4).

Figure 5:
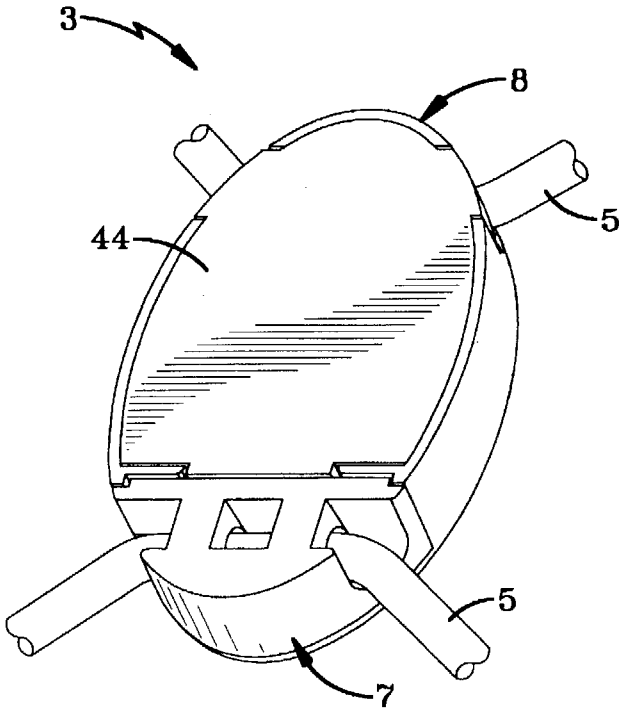
FIG. 5 is a perspective view of the locking member of FIGS. 2–4 fully assembled.

Wall 39 is spaced from and parallel to end walls 28 and a third end wall 40 is spaced outwardly from and parallel to second end wall 39 forming a channel 42 therebetween through which another portion of cable 5 extends. An elongated rib 34 is perpendicular to wall 39 and extends inwardly partially across the longitudinal length of bottom member 26 of base 8 and is received in groove 14 of fastener 7 when locking member 3 is in a locked position as shown in FIGS. 4 and 5. An oval shaped cover 44 (FIGS. 2–5) generally similar in size to bottom member 26 encloses base 8 and is seated upon a generally oval-shaped shoulder 45 formed inside of and extending along side wall 26.

In accordance with one of the features of the invention, leg 10 of fastener 7 slides between prongs 29 when pressure is applied to fastener 7 in the direction of arrow A (FIG. 4), and groove 14 of leg 10 receives and is guided by rib 34. Rounded edges 18 of end 17 deflect tines 35 outwardly as fastener 7 is inserted into base 8. When fastener 7 is fully inserted into base 8, lug 11 fills an open area 36 (FIGS. 2 and 3) of bottom member 26 and abuts end walls 28. Notches 23 receive a pair of shoulders 37 which are formed on each end of wall 27, and the resiliency of metal tines 35 causes them to snap into a locked position adjacent to the angular outer portions of tangs 15 and 16. Tines 35 cooperate with tabs 19 of leg 10 and prevent fastener 7 from being removed from base 8.

Locking member 3, except for metal tines 35, preferably is formed of a lightweight, high-strength plastic material which is relatively rust free and unaffected by chemicals and harsh environments to which it may be exposed, with base 8 and cover plate 44 being molded as one-piece members and subsequently secured together by an adhesive, ultrasonic welding, or other type of securement means.

Figure 6:
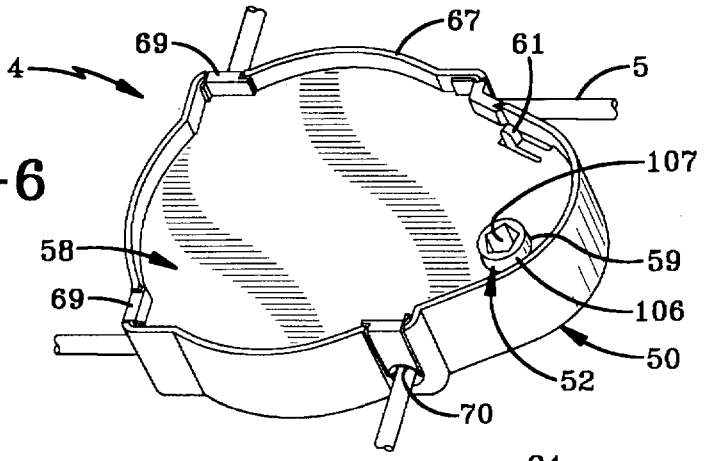
FIG. 6 is a bottom perspective view of the ratchet member of the security device of the present invention fully assembled with partial cables extending outwardly therefrom.
Figure 7:
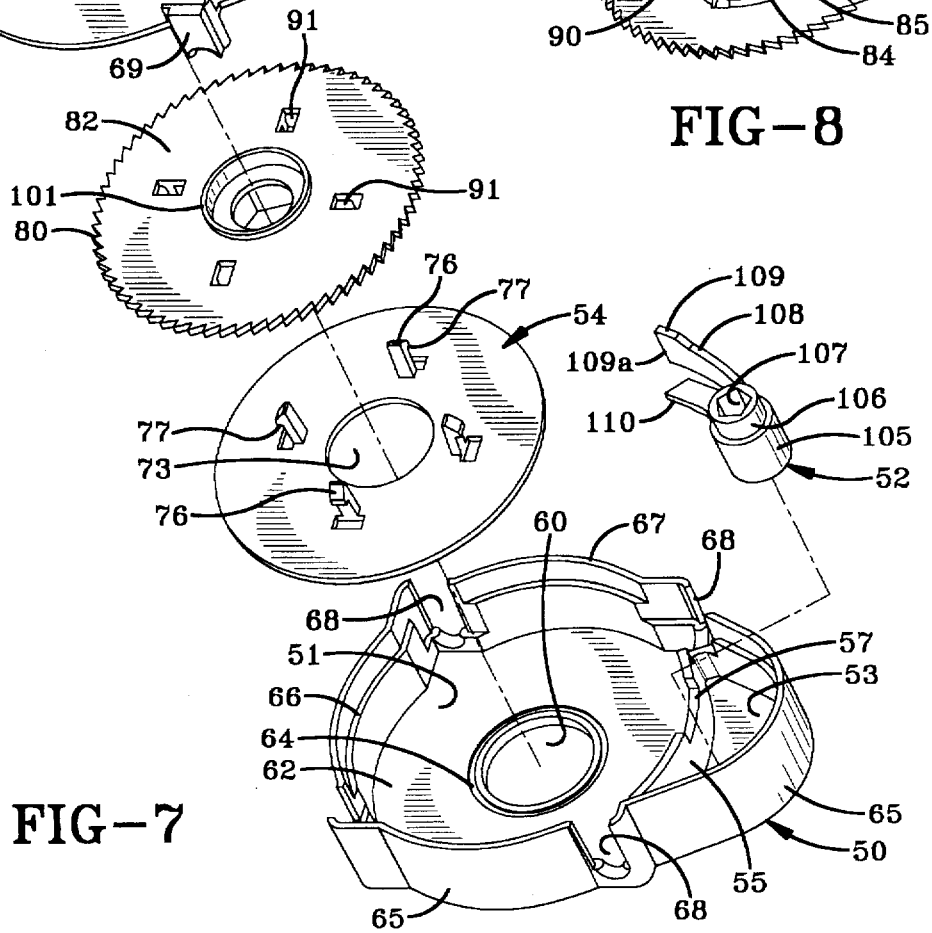
FIG. 7 is an exploded perspective view of the ratchet member of FIG. 6.

Ratchet member 4 is shown assembled in FIG. 6 and unassembled in FIG. 7. Ratchet member 4 includes a housing 50 which is separated into a generally circular compartment 51 and a smaller adjacent compartment 53 by a partition wall 55. A circular-shaped bearing member 54 and a circular-shaped gear 56 are housed within compartment 51 and a pawl 52 is housed within compartment 53. Both compartments 51 and 53 and the contents therein are enclosed by a bottom plate 58. A circular opening 60 is formed in a front wall 62 of housing 50 and an annular groove or bearing surface 64 is formed around circular opening 60. Side wall 65 of housing 50 extends vertically upwardly from front wall 62 and includes an outwardly extending lip or shoulder 66 upon which bottom plate 58 sits when secured to housing 50.

Four U-shaped openings 68 are formed in side wall 65 in a square-shaped configuration and allow four cable sections to pass therethrough, with each cable section being generally perpendicular to the adjacent two cable sections. Bottom plate 58 includes four flanges 69 with an arcuate shaped bottom, which align and cooperate with U-shaped openings 68 to form circular shaped openings 70 therebetween (FIG. 6).

Another circular opening 73 is formed in the center of bearing member 54 (FIG. 7) and an annular nub 75 (FIG. 9) which corresponds to and is received by bearing surface 64, is formed on a bottom surface of bearing member 54. Four flexible projections 76 (FIGS. 7 and 9), which include outward extending latching tabs 77, extend orthogonally from bearing member 54 and are arranged in a square-shaped configuration.

Figure 8:
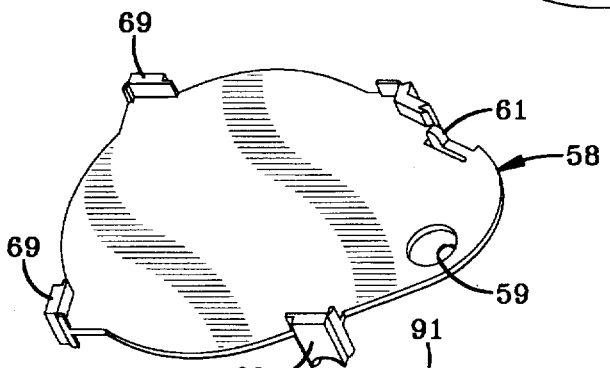
FIG. 8 is a perspective view of the ratchet gear of FIG. 7 in a flipped-over position.
Figure 8:
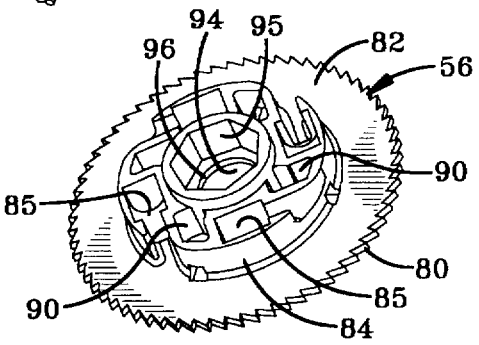
Figure 10:
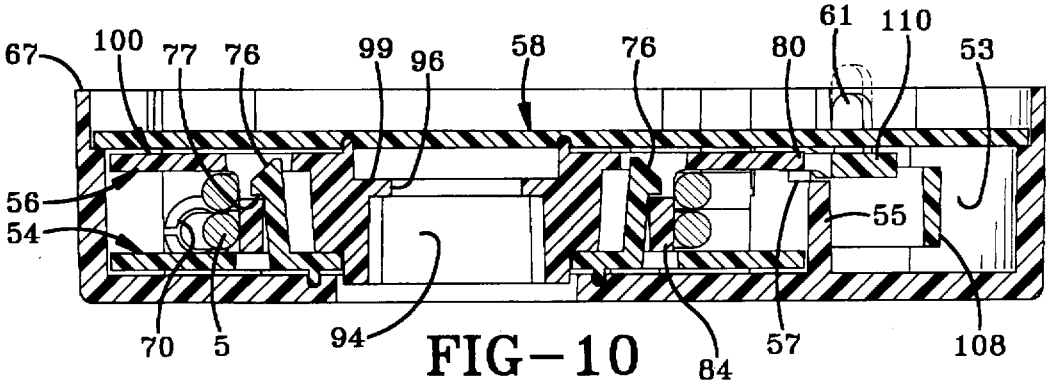
FIG. 10 is a sectional view of the ratchet member taken along line 10—10, FIG. 13.
Figure 11:
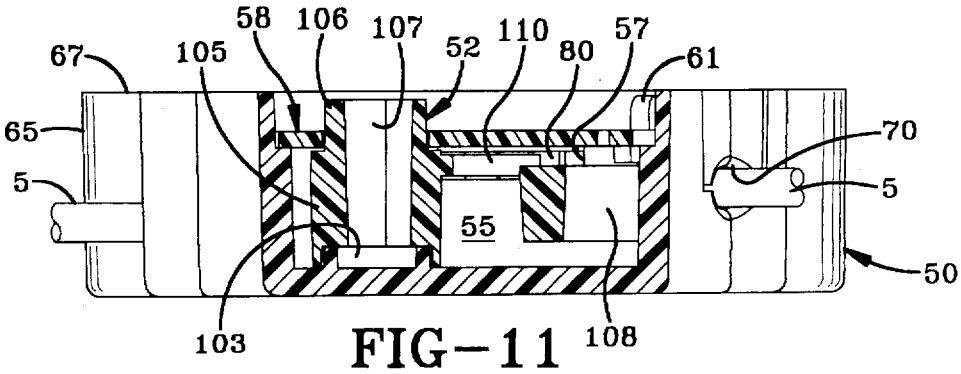
FIG. 11 is a sectional view of the ratchet member taken along line 11—11, FIG. 13.
Figure 12:
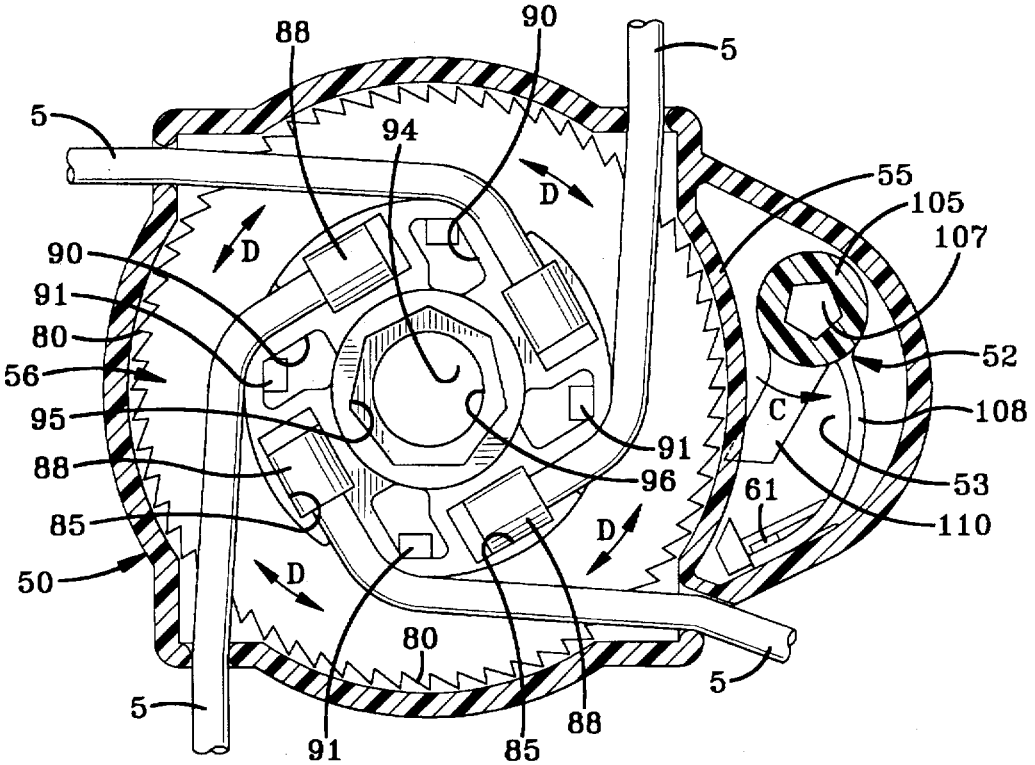
FIG. 12 is a top sectional view of the ratchet member of FIG. 6 showing the ratchet pawl disengaged from the gear.

Gear 56 is shown particularly in FIGS. 7 and 8 and releasably latches to bearing member 54 when ratchet member 4 is assembled as shown in FIGS. 10 and 11. A plurality of teeth 80 extend around an outside edge of gear 56. Gear 56 further includes a disc-shaped plate 82 and a center hub 84 which extends vertically from plate 82. Four openings 85 are formed in hub 84 for receiving and retaining an enlarged end 88 of each section of cable 5 as shown in FIG. 12. Four irregular-shaped holes 90 are formed in hub 84 partially therethrough and four rectangular-shaped holes 91 which communicate with holes 90 are formed completely through gear 56 (FIG. 12). Holes 91 receive projections 76 of bearing member 54 and allow latching tabs 77 to secure bearing member 54 to gear 56 to form a cable-receiving reel 100.

Figure 9:
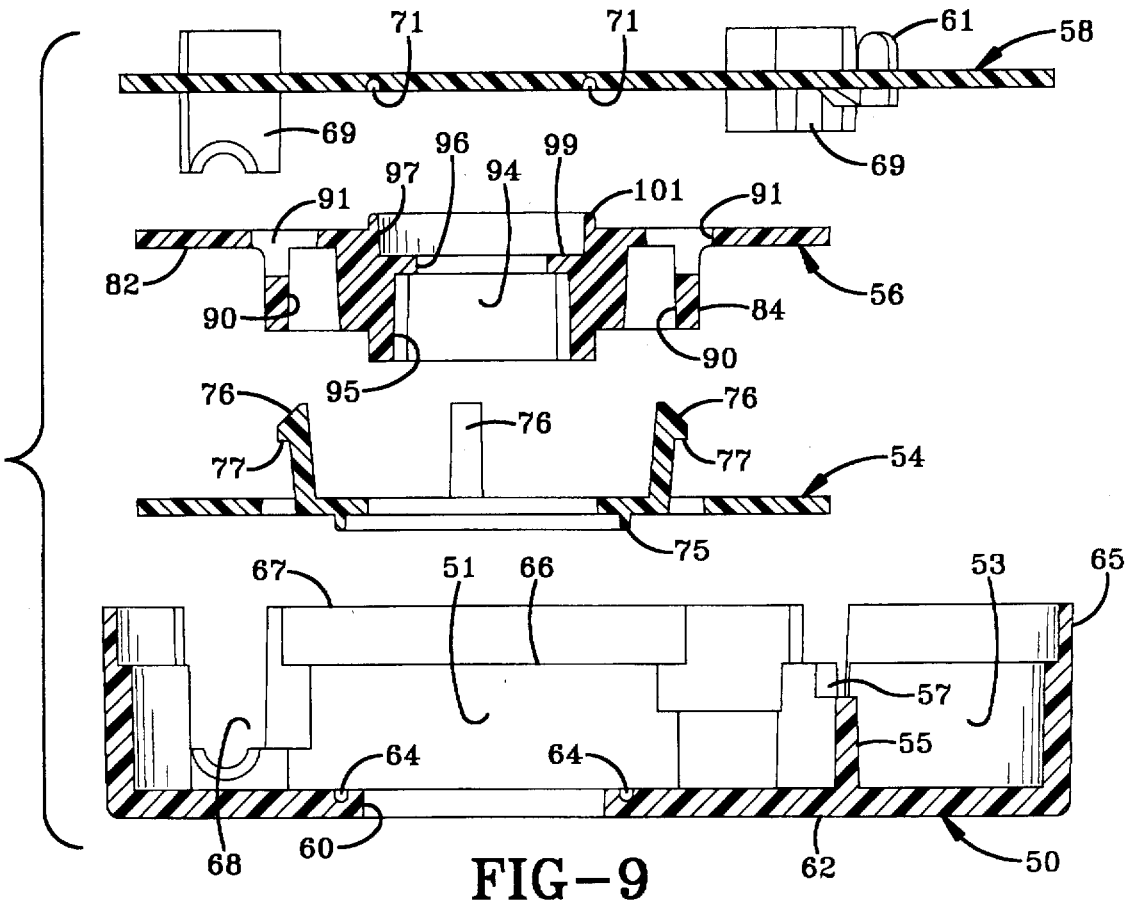
FIG. 9 is an exploded sectional view of the ratchet member of FIG. 7.

A bore 94 is formed through the center of gear 56 and includes a seven sided surface 95 formed in hub 84, a smaller circular opening 96 formed in an annular plate 99 concentrically with and adjacent to seven sided surface 95 (FIGS. 7, 8, 9 and 12) and a larger circular section 97 formed in plate 82 concentrically with and adjacent to circular opening 96 and annular plate 99. An annular nub 101 is formed on a top surface of plate 82 of gear 56 concentrically with bore 94 and is received by a bearing surface 71 formed in bottom plate 58 when ratchet member 4 is assembled as shown in FIGS. 9 and 10.

Pawl 52 has a cylindrical base 105 (FIG. 7), a smaller cylindrical section 106 which has a five-sided central opening 107 formed therein, a resilient spring 108 and a pawl catch 110, both of which extend from a side wall of cylindrical section 105. Pawl 52 is mounted in compartment 53 and is seated upon a circular boss 103 formed on wall 62 (FIG. 11). Cylindrical section 106 extends through a complementary-shaped hole 59 formed in bottom plate 58 (FIGS. 6 and 7) which clamps pawl 52 within housing 50. Resilient spring 108 applies pressure on the inside of side wall 65 forcing catch 110 to extend through a rectangular-shaped opening 57 formed in partition wall 55 and to selectively contact teeth 80 of gear 56 (FIG. 13).

Gear 56, bearing member 54 and hub 84 form a reel 100 when snap-fitted together (FIG. 10) on which cables 5 are wound and unwound when ratchet member 4 is operated as described below. Bearing member 54 lies in circular compartment 51 on front wall 62 with annular nub 75 sitting in bearing surface 64. Two cables 5 are inserted into hub 84 of gear 56 with each enlarged end 88 of the cables secured in opposite openings 85 and with each end of the cables extending through opposite openings 70 oriented 90° with respect to the adjacent openings. Gear 56 is latched to bearing member 54 as described above enclosing an open end of hub 84 and locking the cables therein. Pawl 52 is placed in compartment 53 and bottom plate 58 sits on lip 66 and is secured to housing 50 enclosing compartments 51 and 53. Annular nub 101 of gear 56 sits in bearing surface 71 of bottom plate 58 and along with annular nub 75 and bearing surface 64 allow gear 56 and bearing member 54 to rotate when cable 5 is dispensed from or collected on reel 100.

Figure 13:
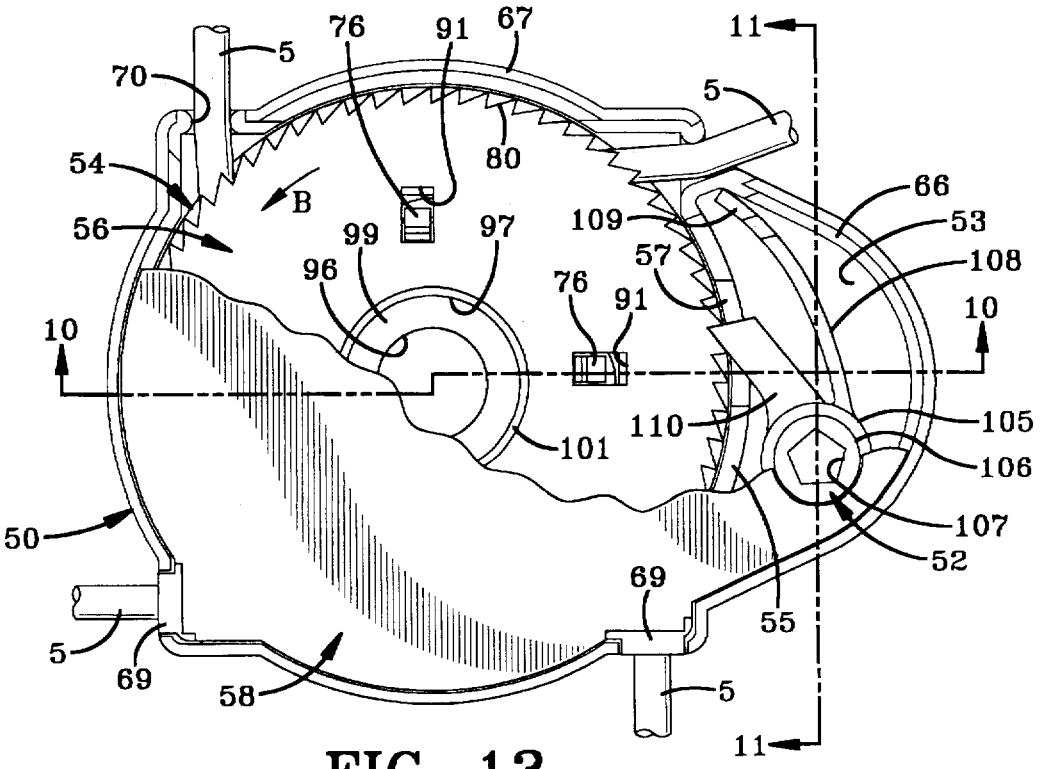
FIG. 13 is a bottom elevational view of the ratchet member of FIG. 6 with a portion of a bottom plate broken away.

In operation, ratchet member 4 is placed against a side of package 2 (FIG. 1) so that bore 94 is exposed for receiving a seven-sided section 117 of a ratchet tool 115 (FIGS. 1 and 13). Fastener 7 and base 8 are snap-fitted together (arrow A, FIG. 4) securing locking member 3 into a locked position and locking universal wrap 1 around package 2. Surface 117 of tool 115 is inserted into multi-sided surface 95 and tool 115 is rotated to turn gear 56 and bearing member 54 in the direction of arrows B (FIG. 13). Catch 110 of pawl 52 catches in teeth 80 of gear 56 as the gear is rotated, preventing reel 100 from rotating in a direction opposite to that of arrow B.

Cables 5 are tightened around package 2 and are collected on reel 100 as tool 115 is turned in the direction of arrows B. Tool 115 is turned until cables 5, locking member 3 and ratchet member 4 are firmly secured around and against package 2, thus preventing the removal of security device 1 from the package and preventing any unauthorized opening thereof.

Figure 15:
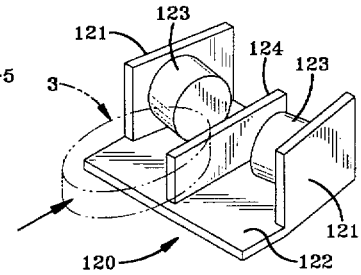
FIG. 15 is a perspective view of the unlocking tool for the locking member.

Universal wrap 1 is removed by placing a key or unlocking tool 120 adjacent locking member 3 as shown by dot-dash lines in FIG. 15. Tool 120 includes a base 122 with a pair of angled magnet support arms 121 on which are mounted permanent magnets 123. A support rib 124 is formed on base 122 and extends upwardly therefrom and extends between arms 121 for properly positioning and guiding locking member 3 into position between magnets 123. The magnetic field of magnets 123 causes metal tines 35 to move outwardly a sufficient distance to allow end 17 and particularly locking tabs 19 of fastener 7, to pass therethrough, thus allowing fastener 7 to be manually removed from its latched condition with base 8. Once locking member 3 has been unlocked and separated, cable 5 is loose enough to allow device 1 to be removed from package 2.

Figure 14:
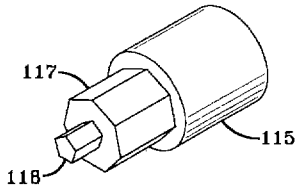
FIG. 14 is a perspective view of the ratchet tool.

Five-sided section 118 of ratchet tool 115 (FIG. 14) can then be inserted into five-sided opening 107 of pawl 52 after it has been removed from the package, and turned in the direction of arrow C (FIG. 12), releasing catch 110 from teeth 80 by compressing spring 108 against side wall 65, making reel 100 freewheeling, as shown by arrows D. When catch 110 is clear of teeth 80, a lockout tab 61, which can be formed as a separate member or as a part of bottom plate 58, is pressed outwardly by a ramped end 109 of spring 108. As shown in FIGS. 11 and 12, tab 61 will have a multi-ramped bottom section which when engaged by ramped end 109 of spring 108 will engage the outer edge 109*a* of spring 108, moving tab 61 into an extended position above the peripheral edge 67 of side wall 65, as shown by dot-dash lines in FIG. 10. This then enables cables 5 to be freely unwound for placement about another package, after which multi-sided section 117 of tool 115 is used to rotate reel 100 and tighten cables 5 about a different package.

Lockout tab 61 is automatically released from ramped end 109 of spring 108 by placing member 3 against a package which pushes tab 61 inwardly disengaging spring 108 therefrom enabling spring 108 to return to its operative position, as shown in sold lines in FIGS. 10, 11 and 13, and move catch 110 into engagement with teeth 80. Universal wrap is then ready to be secured around the package as described above.

Accordingly, security device 1 is wrapped and secured around package 2, preventing the package from being opened. Cables 5 extend through fastener 7 and base 8 of locking member 3 and the fastener and base are snap-fitted together. Metal tines 35 lock under locking tabs 19 securing fastener 7 to base 8. Annular nubs 75 and 101 sit in bearing surfaces 64 and 71, respectively, allowing bearing reel 100 to rotate freely within housing 50. Also, catch 110 of pawl 52 catches in teeth 80 of gear 56 allowing the reel to rotate in only one direction. Moreover, seven-sided key 117 of tool 115 rotates the reel tightening and securing cables 5 and thus universal wrap 1 around package 2. Further, magnets 123 of unlocking tool 120 cause metal tines 35 to deflect outwardly allowing fastener 7 to be dismantled from base 8 and further allowing security device 1 to be removed from package 2. Tool 115 is used to disengage pawl 52 from teeth 80, as well as to tighten cables 5 about an object. Lockout device 61 also allows cables 5 to be wound and stored on the reel for future use of the security device.

It is readily understood that cables 5 could be replaced with other flexible members made of plastic, chains, fibers, and similar materials, and will be covered by the term "cables" as used in the above description. Furthermore, locking member 3 will be formed of a high-strength plastic material, with the exception of metal tines 35, thereby rendering it unaffected by moisture, chemicals and other harsh environments in which it may be used, and will prevent it from marring the objects on which it is mounted. Likewise, ratchet member 4 is constructed of a similar high-strength plastic material, providing similar advantages as those discussed above with respect to locking member 3.

Also, an electronic article surveillance tag (EAS) 112 can be mounted on the rear surface of locking member 3, as shown in FIG. 1, or on the rear surface of ratchet member 4, when used in a retail store having an EAS security system at the exit, to prevent unauthorized removal of the package. Thus, security device 1 can be used to securely retain a package or object in a closed position, as well as preventing its removal from a retail store having such EAS security systems.

Also, even should a prospective thief insert an object into hub opening 94, it will only permit tightening of the cables instead of loosening them on the package, since the opening 107 of locking member 3, which is used to release the locking pawl, is inaccessible since it is pressed against the package.

Accordingly, the improved security device is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved security device is constructed and used, the characteristics of the construction, and the advantageous, new and useful results obtained; the new and useful structures, devices, elements, arrangements, parts and combinations, are set forth in the appended claims.

We claim:

1. A security device adapted to be placed about an object to prevent said object from being opened, said device including:

cable means including first and second cables for placement about the object to be secured;

ratchet means connected to the cable means for tightening the cable means around the object;

a two-piece locking member including a base and a fastener which releasably snap-fits into the base, each of said pieces being connected to the cable means and releasably engaged with each other for releasably locking said cable means about the object; and said first cable extending between and connected to the ratchet means and to the base of the locking member and the second cable extending between and connected to the ratchet means and the fastener of the locking member.

2. The security device defined in claim 1 in which the fastener includes locking tabs; and in which the base includes metal tines which cooperate with the locking tabs of the fastener to releasably secure the fastener to said base.

3. The security device defined in claim 2 in which the unlocking tool includes magnets which disengage said metal tines from the locking tabs.

4. The security device defined in claim 3 in which the unlocking tool includes a base, a pair of permanent magnets mounted in a spaced relationship on the base, and positioning means for positioning the locking member between the spaced magnets for releasing the metal tines from the locking tabs.

5. The security device defined in claim 4 in which the positioning means is a rib mounted on the base and extending between the spaced magnets.

6. The security device defined in claim 2 in which the base includes a cover plate which conceals the metal tines within the base.

7. The security device defined in claim 2 in which a guide rib is mounted on the base of the locking member and is slidably engageable with the fastener to assist in releasably securing the fastener to the base.

8. The security device defined in claim 1 in which the ratchet means includes a housing, a reel rotatably mounted within said housing for supporting the cable means, and a pawl which operatively engages the reel to latch the reel in a fixed position to maintain the cable means tightened around the object.

9. The security device defined in claim 8 in which the reel includes a hub and spaced first and second end flanges, said first flange having a plurality of teeth formed around an outside edge thereof.

10. The security device defined in claim 9 in which a plurality of openings are formed in the hub for receiving enlarged ends of the cable means to secure said cable means to the hub.

11. The security device defined in claim 9 which the first and second cables provide four cable sections; and in which each of the said cable sections extends through an opening formed in the housing substantially perpendicularly with respect to two adjacent cable sections.

12. The security device defined in claim 9 in which the ratchet means includes a lock-out mechanism for releasably securing the pawl out of operative engagement with the reel.

13. The security device defined in claim 12 in which the lock-out mechanism includes a lock-out tab movably mounted on the housing and engageable by the pawl upon the pawl being manually moved to a disengaged position from the reel to releasably secure the pawl in said disengaged position.

14. The security device defined in claim 13 in which a portion of the lock-out tab extends outwardly beyond the housing and is adapted to be engaged by the object when the ratchet means is placed on said object to move the lock-out tab into engagement with the pawl.

15. The security device defined in claim 14 in which the pawl includes a base with a resilient spring and a catch extending from said base; and in which said catch selectively engages the teeth formed on the first flange of the reel to provide for one-way rotation of the reel when engaged by said catch.

16. The security device defined in claim 15 in which at least one of the spring and lock-out tab is formed with a ramped surface which is slidably engaged by the other of said spring and lock-out tab to move the pawl catch between engaged and disengaged positions with the reel.

17. The security device defined in claim 14 in which the device includes a ratchet tool; and in which the pawl is formed with an opening having a multi-sided bore which is engaged by a multi-sided first section of the ratchet tool for moving said pawl out of operative engagement with the reel.

18. The security device defined in claim 17 in which the ratchet tool includes a multi-sided second section; and in which the hub is formed with a multi-sided bore engageable with the second section of the ratchet tool for rotating the reel to tighten the cable means around the object.

19. A security device adapted to be placed about an object to prevent said object from being opened, said device including:

cable means for placement about the object to be secured;

ratchet means connected to the cable means for tightening the cable means around the object;

a two-piece locking member including a base and a fastener which releasably snap-fits into the base, each piece of said locking member being connected to the cable means, said pieces being releasably engaged with each other for releasably locking said cable means about the object, said fastener including locking tabs and the base including metal tines which cooperate with the locking tabs of the fastener to releasably secure the fastener to said base; and an unlocking tool including magnets for disengaging the metal tines from the locking tabs of the fastener.

20. A security device adapted to be placed about an object to prevent said object from being opened, said device including:

cable means for placement about the object to be secured;

ratchet means connected to the cable means for tightening the cable means around the object, the ratchet means including a housing, a reel rotatably mounted within said housing for supporting the cable means, and a pawl which operatively engages the reel to ratchet the reel in a fixed position to maintain the cable means tightened around the object, said reel including a hub and spaced first and second end flanges, said first flange having a plurality of teeth formed around an outside edge thereof, and a plurality of openings being formed in the hub for receiving enlarged ends of the cable means to secure said cable means to the hub; and a two-piece locking member, each piece being connected to the cable means, said pieces being releasably engaged with each other for releasably locking said cable means about the object.

21. A security device adapted to be placed about an object to prevent said object from being opened, said device including:

cable means for placement about the object to be secured;

ratchet means connected to the cable means for tightening the cable means around the object, said ratchet means including a housing, a reel rotatably mounted within said housing for supporting the cable means, and a pawl which operatively engages the reel to latch the reel in a fixed position to maintain the cable means tightened around the object, said reel including a hub and spaced first and second end flanges, said first flange having a plurality of teeth formed around an outside edge thereof;

said cable means including four cable sections, each of the said cable sections extending through an opening formed in the housing substantially perpendicularly with respect to the two adjacent cable sections; and a two-piece locking member, each piece being connected to the cable means, said pieces being releasably engaged with each other for releasably locking said cable means about the object.

* * * * *